US012359861B2

(12) United States Patent
Puschmann et al.

(10) Patent No.: US 12,359,861 B2
(45) Date of Patent: Jul. 15, 2025

(54) PORTABLE COOLING UNIT

(71) Applicant: SECOP GMBH, Flensburg (DE)

(72) Inventors: Olaf Puschmann, Wanderup (DE); Sebastian Echelmeyer, Flensburg (DE)

(73) Assignee: SECOP GMBH, Flensburg (DE)

( * ) Notice: Subject to any disclaimer, the term of this patent is extended or adjusted under 35 U.S.C. 154(b) by 220 days.

(21) Appl. No.: 18/267,614

(22) PCT Filed: Dec. 16, 2021

(86) PCT No.: PCT/EP2021/086315
§ 371 (c)(1),
(2) Date: Jun. 15, 2023

(87) PCT Pub. No.: WO2022/129416
PCT Pub. Date: Jun. 23, 2022

(65) Prior Publication Data

US 2024/0053083 A1 Feb. 15, 2024

(30) Foreign Application Priority Data

Dec. 17, 2020 (EP) ..... 20215138

(51) Int. Cl.
*F25D 11/00* (2006.01)
*F25D 23/00* (2006.01)

(52) U.S. Cl.
CPC ..... *F25D 11/003* (2013.01); *F25D 23/006* (2013.01)

(58) Field of Classification Search
CPC .. F25D 23/006; F25B 31/002; F25B 2500/13; F25B 5/00–5/04
See application file for complete search history.

(56) References Cited

U.S. PATENT DOCUMENTS 12,246,635 B2 * 3/2025 Lee ..... B60H 1/00264

FOREIGN PATENT DOCUMENTS

EP 1596144 A1 11/2005
EP 3572747 A1 11/2019
(Continued)

*Primary Examiner* — Cassey D Bauer
(74) *Attorney, Agent, or Firm* — Dykema Gossett PLLC

(57) ABSTRACT

Portable cooling unit (1) for transporting temperature-sensitive goods while maintaining a desired cooling temperature, said portable cooling unit (1) comprising a multi-stage cascade refrigeration system (2) adapted to operate during transport of the portable cooling unit (1) and to cool down to and maintain temperatures of more than 70 K below ambient temperature, a suspension system (3) adapted and arranged to serve as elastic bearing for the multi-stage cascade refrigeration system (2) and/or for components of the multi-stage cascade refrigeration system (2), a movement delimiting system (4) adapted and arranged to restrict movement of the multi-stage cascade refrigeration system (2) and/or the components of the multi-stage cascade refrigeration system (2), an impact protection system (5) adapted and arranged to dampen collisions between the multi-stage cascade refrigeration system (2) and other parts of the portable cooling unit (1), and/or between the components of the multi-stage cascade refrigeration system (2), a lubrication system (6) facilitating lubrication of the components of the multi-stage cascade refrigeration system (2) for inclinations of at least 10° out of horizontal orientation of the portable cooling unit (1), and a monitoring system (7) adapted to generate an alarm signal upon malfunction of the portable cooling unit (1).

10 Claims, 2 Drawing Sheets

(56) References Cited

FOREIGN PATENT DOCUMENTS

| | | | |
|---|---|---|---|
| FR | 2693541 | A1 | 1/1994 |
| WO | 2006041146 | A1 | 4/2006 |

* cited by examiner

PORTABLE COOLING UNIT

CROSS-REFERENCE TO RELATED APPLICATION

This application is a national stage filing based upon International application No. PCT/EP2021/086315, filed 16 Dec. 2021, which claims the benefit of priority to Europe application Ser. No. 20/215,138.7, filed 17 Dec. 2020.

FIELD OF THE INVENTION

The present invention relates to a portable cooling unit for transporting temperature-sensitive goods while maintaining a desired cooling temperature.

STATE OF THE ART

Portable cooling units are generally known. However, such cooling units working with passive cooling by dry ice or liquid nitrogen cannot be employed in connection with highly temperature-sensitive goods due to their unreliability over long periods of time and dissipation of the limited supply of cooling medium.

Moreover, also portable cooling units which are based on Stirling cooling systems are not suited for highly temperature-sensitive goods since their comparatively low cooling capacity prevents fast recovery of the desired or required cooling temperature, e.g. after a door opening has occurred.

In general, such portable cooling units are not capable of cooling down to and maintaining temperatures lower than 60-70K below ambient temperature which makes them unsuitable for transportation of highly temperature-sensitive goods, like vaccines.

Stationary cooling units, on the other hand, avoid some of the disadvantages mentioned above. However, since stationary systems are used only under controlled conditions, like indoor laboratories or stock areas, these systems are not suited for large differences between ambient and desired cooling temperature; rather they are designed to operate under certain predefined ambient temperatures or narrow ambient-temperature bands. This applies also to other ambient conditions like ambient pressure.

In addition, stationary systems do not allow for operation while in inclined orientation, i.e. they are not portable. Rather, such inclinations lead to malfunction of or damage to stationary systems.

Thus, there is a lack of transportable cooling units for reliably transporting highly temperature-sensitive goods while maintaining a desired cooling temperature of more than 70K below ambient temperature under varying ambient conditions.

OBJECTIVE OF THE INVENTION

It is therefore an object of the present invention to provide a portable cooling unit for reliably transporting highly temperature-sensitive goods while maintaining a desired cooling temperature of more than 70K below ambient temperature under varying ambient conditions and for a prolonged period of time.

Further objects of the invention become apparent from the presentation of the invention below.

PRESENTATION OF THE INVENTION

An object of the invention is solved by means of a portable cooling unit for transporting temperature-sensitive goods while maintaining a desired cooling temperature, said portable cooling unit comprising

- a multi-stage cascade refrigeration system adapted to operate during transport of the portable cooling unit and to cool down to and maintain temperatures of more than 70 K, preferably more than 120 K, below ambient temperature,
- a suspension system adapted and arranged to serve as elastic bearing for the multi-stage cascade refrigeration system and/or for components of the multi-stage cascade refrigeration system,
- a movement delimiting system adapted and arranged to restrict movement of the multi-stage cascade refrigeration system and/or the components of the multi-stage cascade refrigeration system,
- an impact protection system adapted and arranged to dampen collisions between the multi-stage cascade refrigeration system and other parts of the portable cooling unit, and/or between the components of the multi-stage cascade refrigeration system,
- a lubrication system facilitating lubrication of the components of the multi-stage cascade refrigeration system for inclinations of the portable cooling unit of at least 10°, preferably of more than 20°, out of horizontal orientation, and
- a monitoring system adapted to generate an alarm signal upon malfunction of the portable cooling unit.

Due to this particular combination of features, the portable cooling unit avoids all of the aforementioned disadvantages. The employed multi-stage cascade refrigeration system provides for sufficient cooling power and the realisation and maintenance of the desired or required cooling temperature, i.e. target temperature; the suspension system, the movement delimiting system, and the impact protection system act as special means of protection for the multi-stage cascade refrigeration system during transport of the cooling unit, thereby rendering said multi-stage cascade refrigeration system suitable for operation during transport of the cooling unit and thus rendering the cooling unit portable; the lubrication system reliably prevents malfunction of the multi-stage cascade refrigeration system in inclined positions, which the portable cooling unit will assume quite commonly during transport; and the monitoring system secures protection of the temperature-sensitive goods in case of malfunction of the cooling unit, since it allows for early detection of the malfunction and for swift measures to be taken.

The term "portable" means within the scope of the present invention that the cooling unit is able to normally operate during transportation, particularly when the cooling unit is inclined by at least 10° out of horizontal orientation.

In a preferred embodiment of the portable cooling unit according to the invention, its weight is 50 kg or less.

This facilitates handling of the portable cooling unit by the responsible personnel, since high weight would increase the risk of injuries or damage, and would increase roughness of the handling.

In a preferred embodiment of the portable cooling unit according to the invention, it comprises at least one, preferably two, handles for easy handling of the portable cooling unit.

This further increases handling safety and stability of the cooling unit during transport. In particular, the cooling unit may be kept in horizontal orientation more easily, thus minimising the risk of malfunction of the multi-stage cascade refrigeration system and its components during transport.

In another preferred embodiment of the portable cooling unit according to the invention, the multi-stage cascade refrigeration system is realised as a two-stage cascade refrigeration system.

Employing a two-stage cascade refrigeration system renders the portable cooling unit suitable for operation in connection with a wide range of ambient temperatures in a particularly efficient manner. While having a design simple and robust enough for being employed in portable cooling units, it allows for the desired temperature difference to be split into two steps by utilising two thermally connected standard refrigeration systems, e.g. two vapour-compression refrigeration systems, to cool down from ambient temperature of the cooling unit's ambient air to an intermediate temperature, also called intercooler temperature, in a first step, and from said intermediate temperature down to the target temperature of the cooling unit, also called target temperature, in a second step. Thereby, one can rely purely on standard components found in other devices used in light commercial cooling industry, without losing reliability due to overloading when dealing with the kind of temperature differences relevant for independent portable cooling units.

In another preferred embodiment of the portable cooling unit according to the invention, a high-temperature refrigeration cycle of the two-stage cascade refrigeration system comprises a first compressor featuring a cooling capacity of 60 W at an ambient temperature of 43° C. at the cycle's condenser, and an intercooler temperature of −25° C. at the cycle's evaporator.

In another preferred embodiment of the portable cooling unit according to the invention, a low-temperature refrigeration cycle of the two-stage cascade refrigeration system comprises a second compressor featuring a cooling capacity of 30 W at an intercooler temperature of −25° C. at the cycle's condenser, and a target temperature of −80° C. at the cycle's evaporator.

This design of the two-stage cascade refrigeration system enables the portable cooling unit to quickly cool down the highly temperature-sensitive goods to the target temperature, and to maintain said temperature without overloading the refrigeration cycles (e.g. the two vapour-compression refrigeration systems).

The evaporator of the high-temperature refrigeration cycle and the condenser of the low-temperature refrigeration cycle together with the thermal coupling between them form the two-stage cascade refrigeration system's intercooler. The high-temperature refrigeration cycle can be designed to feature a heat dissipation between the condenser and ambient air of 120 W with a temperature difference of 10K, and a heat intake at the evaporator (i.e. intercooler) of 60 W with a temperature difference of 5K. The low-temperature refrigeration cycle, on the other hand, can be designed to feature a heat dissipation at the condenser (i.e. intercooler) of 60 W with a temperature difference of 5K, and a heat intake from the active cooling compartment to the evaporator of 30 W with a temperature difference of 10K. Thereby, the cooling compartment is defined as the portable cooling unit's volume where the temperature-sensitive goods are kept.

By means of such a design, the portable cooling unit is enabled to quickly re-establish the target temperature after the cooling process has been interrupted, e.g. after a door of the cooling compartment has been opened.

In another preferred embodiment of the portable cooling unit according to the invention, the high-temperature refrigeration cycle of the two-stage cascade refrigeration system features Propane as refrigerant, and the low-temperature refrigeration cycle of the two-stage cascade refrigeration system features Ethane as refrigerant.

With the combination of these particular refrigerants for the high- and low-temperature refrigeration cycles, the two-stage cascade refrigeration system may be operated in a particularly effective manner, particularly under varying external conditions as they are encountered during transportation.

In another preferred embodiment of the portable cooling unit according to the invention, each refrigeration cycle's compressor features a motor-compression-unit which is elastically suspended inside the respective compressor's housing by means of multiple springs.

Thereby, vibration and sound transmission between the motor-compression-unit and the compressor's housing may be minimized. Furthermore, by elastically suspending the motor-compression unit inside the respective compressor housing, said compressor becomes particularly well suited for portable uses since different orientations and/or positions of the compressor do not affect the operability of the motor-compression unit. Furthermore, since the elastic suspension can be facilitated by a plurality of springs which are supported at the base of the compressor housing, these springs are submerged, at least partially, into a lubricant sump (or oil sump) covering the base in the operating state of the compressor, which further dampens the vibration and sound transmission.

In another preferred embodiment of the portable cooling unit according to the invention, said motor-compression unit features multiple spacer elements made of elastic material, said spacer elements being arranged on a surface of the motor-compression-unit and protruding from said surface towards the compressor's housing.

Said elastic spacer elements serve as dedicated means of protection against collisions between the motor-compression unit and the respective compressor's housing. Such protection is necessary for rendering the cooling unit portable, i.e. being able to normally operate during transport, despite of varying orientations and positions the cooling unit may take during transport. As such, the spacer elements may serve as impact protection system. Said elastic spacer elements may as well serve as movement delimiting system, since the dimensions of the spacer elements may be chosen such that only a predefined displacement from the motor-compression unit's resting position is allowed.

In another preferred embodiment of the portable cooling unit according to the invention, said compressor features a lubricant receptacle which is attached to a crankshaft of said motor-compression unit such that the lubricant receptacle protrudes at least in portions into the lubricant sump of said compressor.

In this way, steady lubrication of the motor-compression unit can be guaranteed even when the cooling unit is not in horizontal orientation. In such situations, the lubricant receptacle still protrudes at least in portions into said lubricant sump covering the base of the compressor housing in the operating state of the compressor, thus facilitating steady lubricant supply to the critical components that require lubrication. The lubricant may be conveyed from the sump to the critical components by standard means for lubricant conveyance, e.g. grooves in the crankshaft's surface, eccentric bores and/or outlet openings within the crankshaft.

In a preferred embodiment, the lubricant may enter the lubricant receptacle and the crankshaft through an inlet opening of said lubricant receptacle and may form a lubricant paraboloid upon rotation of the crankshaft—which also leads to a rotation of the lubricant receptacle attached to the crankshaft. The lubricant may then exit the interior of a rotationally symmetric, hollow region of the crankshaft through an outlet opening which is arranged at the high point of the lubricant paraboloid in the crankshaft's outer surface. From there, the lubricant may either be directed towards critical components of the motor-compression unit that need lubrication, or it may be guided into further means of conveyance, e.g. grooves in the crankshaft's surface.

BRIEF DESCRIPTION OF THE FIGURES

A brief description of the invention using figures of an exemplary embodiment now follows. Thereby shows.

WAYS OF CARRYING OUT THE INVENTION

Figure 1:
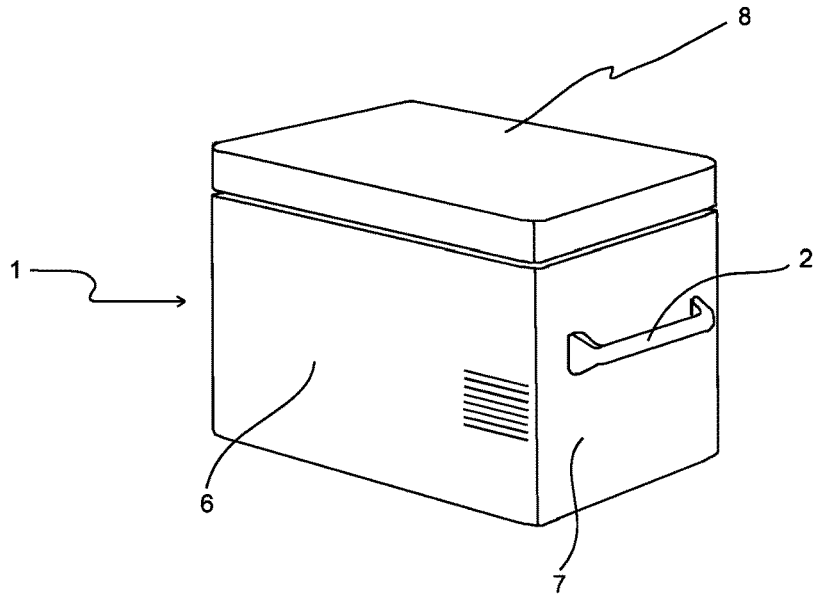
FIG. 1 a perspective view of a portable cooling unit

FIG. 1 depicts a portable cooling unit 1 according to the invention featuring two handles 2 (only one of which is visible in FIG. 1, cf.

Figure 2:
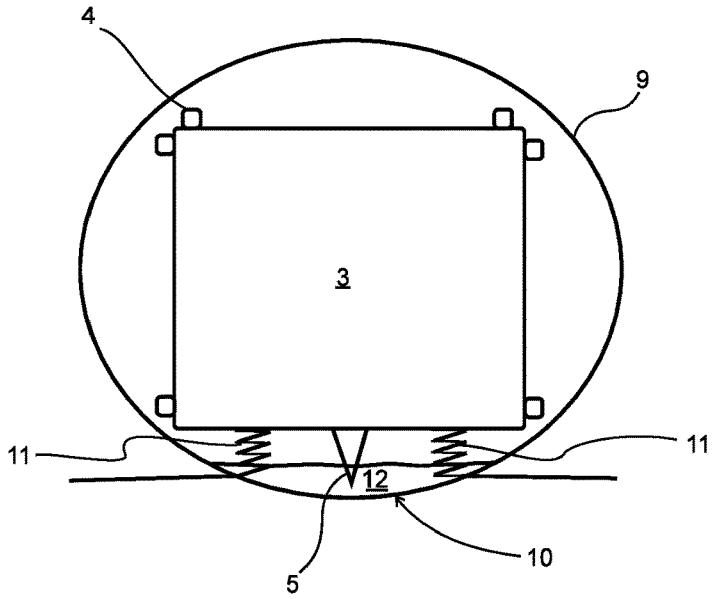
FIG. 2 a schematic view of a compressor of one refrigeration cycle of the multi-stage cascade refrigeration system FIG. 3 a perspective view of a portable cooling unit during transportation in an inclined orientation FIG. 4 a schematic view of a compressor of one refrigeration cycle of the multi-stage cascade refrigeration system during transportation in an inclined orientation

FIG. 2) on opposite outer surfaces of the cooling unit's 1 body. The cooling unit 1 is divided into an insulated cooling compartment 6, where highly temperature-sensitive goods are stored during transportation, and a separate machine compartment 7 housing a multi-stage cascade refrigeration system. The cooling compartment 6 is closed off against ambient air by a door 8.

Said multi-stage refrigeration system may be realised as a two-stage cascade refrigeration system comprising two vapour-compression refrigeration systems forming a high-temperature refrigeration cycle and a low-temperature refrigeration cycle respectively. Each one of these refrigeration cycles comprises a compressor designed as shown in FIG. 2.

In FIG. 2 said compressor is shown to comprise a compressor housing 9 and a motor-compression unit 3 which is elastically suspended on a base 10 of the compressor housing 9 by means of multiple springs 11 forming a suspension system. The motor-compression unit 3 features multiple spacer elements 4 made of elastic material, said spacer elements 4 being arranged on an outer surface of the motor-compression unit 3 and protruding from said outer surface towards the compressor housing 9. These spacer elements 4 act as impact protection system since their resilient design dampens any collisions between the elastically suspended motor-compression unit 3 and the compressor housing 9. At the same time, the spacer elements 4 may act as a movement delimiting system by choosing the dimensions of the spacer elements 4 such that only a predefined displacement from a motor-compression unit's 3 resting position is allowed (FIG. 4).

Figure 3:
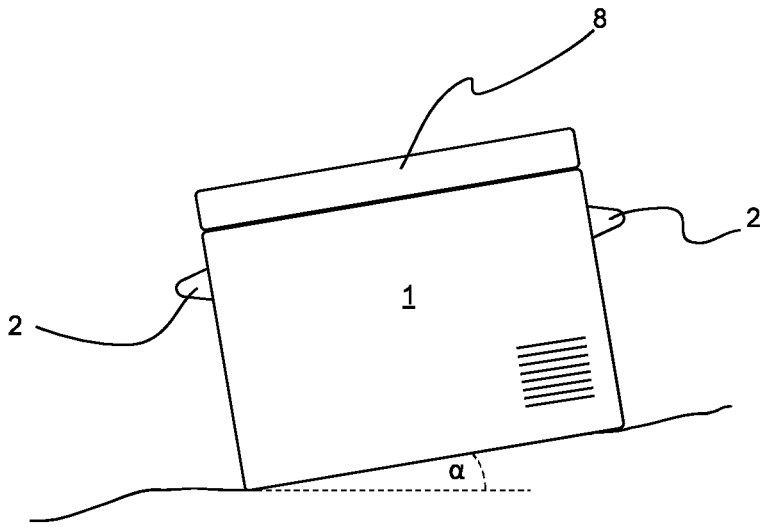
Figure 4:
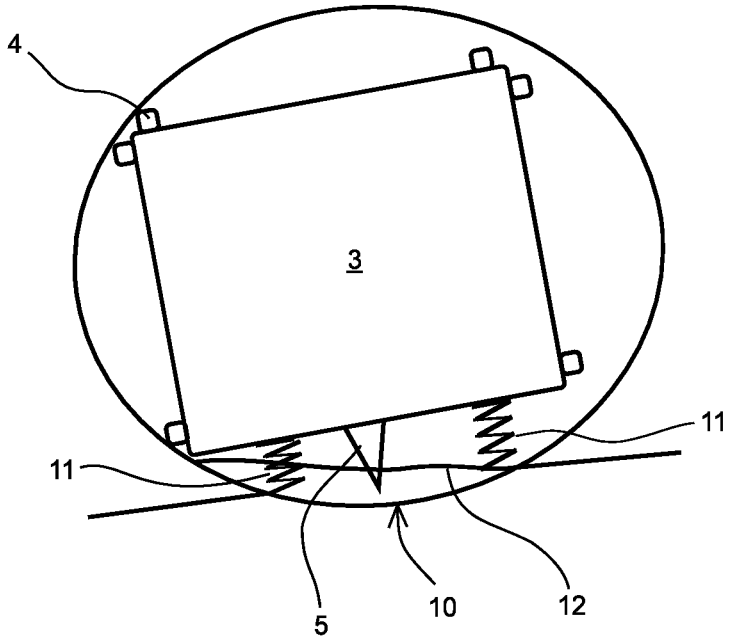

Moreover, FIGS. 2 and 4 schematically indicate a lubricant receptacle 5 attached to a crankshaft (not shown) of the motor-compression unit 3 such that the lubricant receptacle 5 protrudes into a lubricant sump 12 of said compressor. This lubricant receptacle 5 forms a lubrication system, possibly together with other means for lubricant conveyance, e.g. grooves in the crankshaft's surface, eccentric bores and/or outlet openings within the crankshaft. Said lubrication system guarantees steady lubrication of the motor-compression unit 3 (or its components), even in situations where the portable cooling unit 1 is tilted by an angle $\alpha$ out of horizontal orientation (as shown in FIGS. 3 and 4). While compressors used in stationary refrigeration systems would run the risk of taking substantial damage due to a lack of lubrication at certain inclinations, since at least parts of the bottom region of the motor-compression unit 3 would no longer be submerged into the lubricant sump 12, the lubricant receptacle 5 still protrudes into the lubricant sump 12 even at such inclinations (FIG. 4).

As it is essential to immediately detect and counteract malfunctions of the portable cooling unit 1 in order to prevent the highly temperature-sensitive goods (e.g. vaccines) from taking damage or becoming unusable, the portable cooling unit 1 also comprises a monitoring system adapted to immediately generate an alarm signal upon malfunction of the portable cooling unit. Said alarm signal may, for instance, be generated upon detection of a certain increase in temperature in the cooling compartment, and/or exceedance of a certain inclination angle $\alpha$, and/or exceedance of a certain ambient temperature.

LIST OF REFERENCE SIGNS

1 Portable cooling unit
2 handle
3 motor-compression unit
4 spacer elements
5 lubricant receptacle
6 cooling compartment
7 machine compartment
8 door of the cooling compartment
9 compressor housing
10 base of the compressor housing
11 springs
12 lubricant sump

The invention claimed is:

1. Portable cooling unit for transporting temperature-sensitive goods while maintaining a desired cooling temperature, said portable cooling unit comprising a multi-stage cascade refrigeration system adapted to operate during transport of the portable cooling unit and to cool down to and maintain temperatures of more than 70 K below ambient temperature, a suspension system adapted and arranged to serve as elastic bearing for the multi-stage cascade refrigeration system and/or for components of the multi-stage cascade refrigeration system, a movement delimiting system adapted and arranged to restrict movement of the multi-stage cascade refrigeration system and/or the components of the multi-stage cascade refrigeration system, an impact protection system adapted and arranged to dampen collisions between the multi-stage cascade refrigeration system and other parts of the portable cooling unit (1), and/or between the components of the multi-stage cascade refrigeration system, a lubrication system facilitating lubrication of the components of the multi-stage cascade refrigeration system for inclinations of at least 10°, out of horizontal orientation of the portable cooling unit, and a monitoring system adapted to generate an alarm signal upon malfunction of the portable cooling unit.

2. Portable cooling unit according to claim 1, wherein a weight of the portable cooling unit is 50 kg or less.

3. Portable cooling unit according to claim 1, wherein the portable cooling unit includes at least one handle for improved handling of the portable cooling unit.

4. Portable cooling unit according to claim 1, wherein the multi-stage cascade refrigeration system is a two-stage cascade refrigeration system.

5. Portable cooling unit according to claim 4, wherein a high-temperature refrigeration cycle of the two-stage cascade refrigeration system includes a first compressor featuring a cooling capacity of 60 W at an ambient temperature of 43° C. of the cycle's condenser, and an intercooler temperature of −25° C. of the cycle's evaporator.

6. Portable cooling unit according to claim 4, wherein a low-temperature refrigeration cycle of the two-stage cascade refrigeration system includes a second compressor featuring a cooling capacity of 30 W at an intercooler temperature of −25° C. of the cycle's condenser, and a desired cooling temperature of −80° C. of the cycle's evaporator.

7. Portable cooling unit according to claim 4, wherein the high-temperature refrigeration cycle of the two-stage cascade refrigeration system features Propane as refrigerant, and the low-temperature refrigeration cycle of the two-stage cascade refrigeration system features Ethane as refrigerant.

8. Portable cooling unit according to claim 1, wherein each refrigeration cycle's compressor features a motor-compression unit which is elastically suspended inside the respective compressor's housing by means of multiple springs.

9. Portable cooling unit according to claim 8, wherein said motor-compression unit features multiple spacer elements made of elastic material, said spacer elements being arranged on a surface of the motor-compression-unit and protruding from said surface towards the compressor's housing.

10. Portable cooling unit according to claim 8, wherein said compressor features a lubricant receptacle which is attached to a crankshaft of said motor-compression unit such that the lubricant receptacle protrudes at least in portions into a lubricant sump of said compressor.

* * * * *